United States Patent [19]

Elphick et al.

[11] Patent Number: 4,510,909

[45] Date of Patent: Apr. 16, 1985

[54] FUEL RAIL ASSEMBLY

[75] Inventors: Thomas G. Elphick, Hilton; Edgar S. Eshleman, Holcomb; Martin J. Field, Churchville, all of N.Y.

[73] Assignee: General Motors Corporation, Detroit, Mich.

[21] Appl. No.: 597,080

[22] Filed: Apr. 5, 1984

[51] Int. Cl.[3] ..... F02M 55/00; F02B 75/22

[52] U.S. Cl. ..... 123/470; 123/469

[58] Field of Search ..... 123/468, 469, 470, 456; 285/345, 328, 330, 337, DIG. 19

[56] References Cited

U.S. PATENT DOCUMENTS 3,776,209 12/1973 Wertheimer .
3,783,844 1/1974 Gural .
3,785,354 1/1974 Moulds .
3,788,287 1/1974 Falen .
3,789,819 2/1974 Moulds .
4,286,563 9/1981 Fahim .
4,403,586 9/1983 Taniguchi ..... 123/468

FOREIGN PATENT DOCUMENTS 2334445 5/1974 Fed. Rep. of Germany ..... 123/468

*Primary Examiner*—Ronald H. Lazarus
*Attorney, Agent, or Firm*—C. K. Veenstra

[57] ABSTRACT

A fuel rail assembly for a V engine has a pair of fuel rails connected by crossover and discharge conduits. The crossover and discharge conduits are secured to the fuel rails in a manner which permits relative motion between the fuel rails without loss of fuel from the fuel rail-conduit intersection.

7 Claims, 7 Drawing Figures

FUEL RAIL ASSEMBLY

TECHNICAL FIELD

This invention relates to a fuel rail assembly for a V-engine.

BACKGROUND

In a fuel rail assembly for a V-engine, a pair of fuel rails are often employed to support and supply fuel to the injectors. The fuel rails are disposed on opposite sides of the engine and rigidly interconnected by supply and discharge lines which supply fuel to and discharge excess fuel from the fuel rails. Such a rigid interconnection does not allow relative movement of the fuel rails during installation of the fuel rail assembly on the engine, leading to complexities in the installation procedure.

SUMMARY OF THE INVENTION

This invention provides a fuel rail assembly for a V-engine in which the fuel rail for one side of the engine may move slightly relative to the fuel rail for the other side of the engine, thereby allowing the fuel rail assembly to be readily installed on the engine.

This invention further provides a fuel rail assembly for a V-engine in which a pair of fuel rails are interconnected by a fuel conduit and in which the fuel rails may experience relative motion without loss of fuel from the rail-conduit intersection.

This invention also provides a fuel rail assembly for an engine in which a fuel body and a fuel conduit have a tube-in-socket connection sealed by an O-ring and are constructed to prevent side loading of the O-ring.

In one embodiment of a fuel rail assembly according to this invention, each of a pair of fuel rails is provided with a conduit socket which opens to the fuel supply passage in the fuel rail, and a conduit is received in the sockets to interconnect the fuel supply passages. To allow relative motion between the fuel rails without loss of fuel from the conduit sockets, the sockets have a stepped bore with an outer portion of larger diameter than an inner portion, the conduit has ends slidably received in the inner portions, and O-rings are engaged between the conduit and the outer portions of the sockets. The conduit has shoulders for preventing displacement of the O-rings out of the outer portions of the sockets, and the relationship of the conduit ends to the inner portions of the sockets and the conduit shoulders to the outer portions of the sockets prevents side loading of the O-rings. Retainers or a bracket or the like are employed to permit relative motion between the conduit and the fuel rails while limiting the relative motion to preclude withdrawal of either end of the conduit from the inner portion of a socket and to further preclude withdrawal of either shoulder from the outer portion of a socket.

The details as well as other features and advantages of two embodiments of this invention are set forth in the remainder of the specification and are shown in the accompanying drawings.

THE PREFERRED EMBODIMENTS

Figure 1:
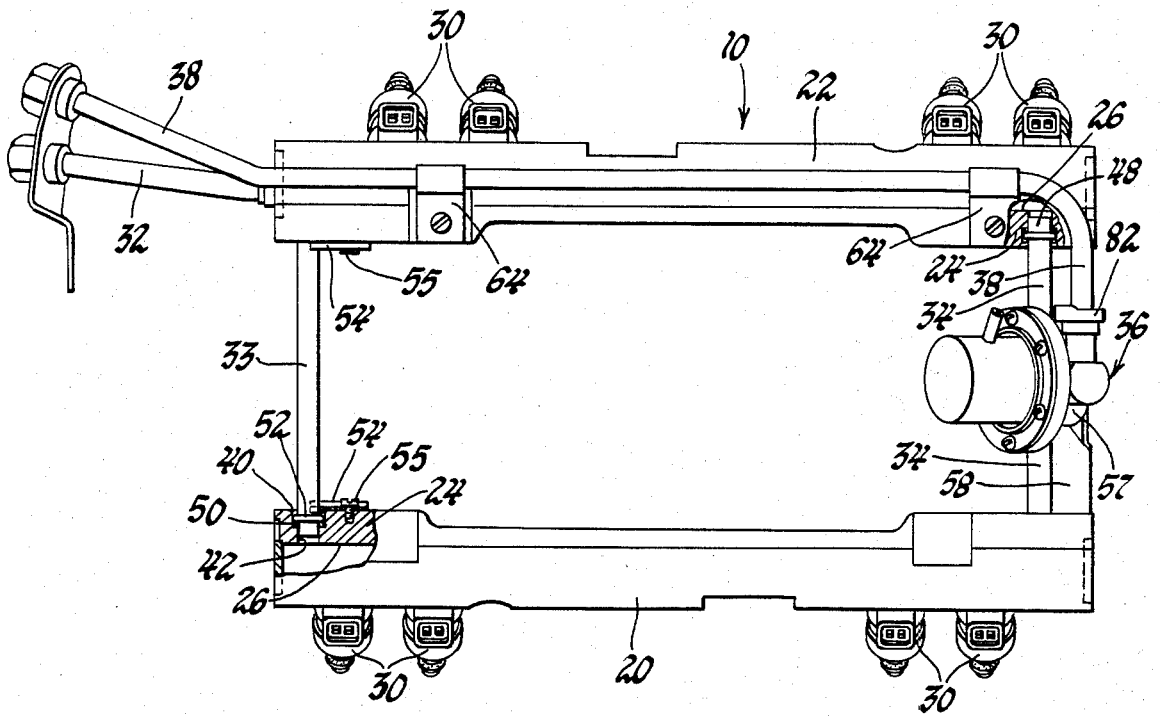
FIG. 1 is a plan view of one fuel rail assembly employing this invention.
Figure 2:
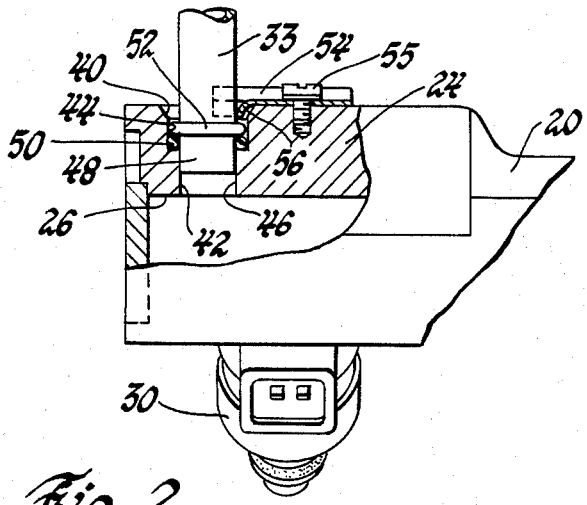
FIG. 2 is an enlarged view of a portion of the FIG. 1 assembly showing the details of construction of the fuel rail-conduit intersection.
Figure 3:
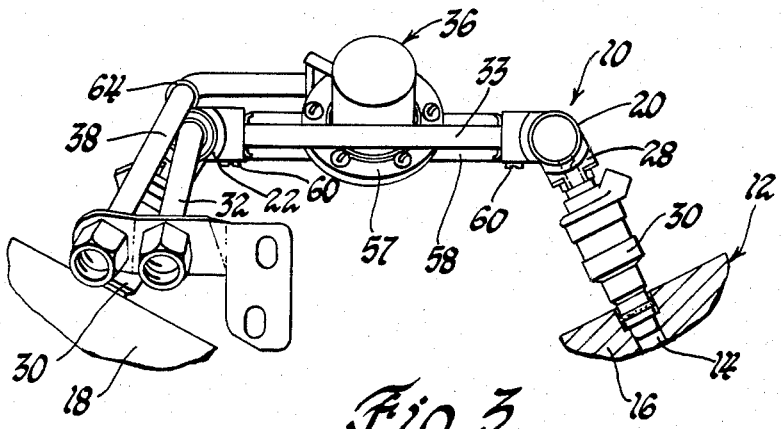
FIG. 3 is an end elevation view of the FIG. 1 fuel rail assembly when installed on an engine.

Referring first to FIGS. 1–3, a fuel rail assembly 10 is mounted on a V-8 engine 12 having eight fuel injection regions 14 arranged in two lines along opposite banks 16 and 18 of engine 12. Fuel rail assembly 10 includes a pair of fuel rails 20 and 22 mounted adjacent the lines of fuel injection regions 14 along banks 16 and 18 respectively.

Each fuel rail 20 and 22 has an extruded body 24 with an axially extending fuel supply passage 26 and four axially spaced injector sockets 28 intersecting fuel supply passage 26 so that fuel supply passage 26 supplies fuel to sockets 28. Each socket 28 receives a fuel injector 30 which delivers fuel from its socket 28 to one of the fuel injection regions 14. Fuel injectors 30 are retained in sockets 28 as set forth in U.S. patent application Ser. No. 490,483 filed May 2, 1983 in the names of T. J. Atkins, M. J. Field and A. J. Makusij.

A fuel supply tube or line 32 supplies fuel to the fuel supply passage 26 of fuel rail 22. A crossover tube or conduit 33 directs fuel from the fuel supply passage 26 of fuel rail 22 to the fuel supply passage 26 of fuel rail 20. A discharge tube or conduit 34 receives excess fuel from both fuel supply passages 26 and directs the excess fuel to a pressure regulator 36. The excess fuel is discharged from pressure regulator 36 through a discharge tube or line 38.

The body 24 of each fuel rail 20 and 22 has a pair of conduit sockets 40 each formed by a stepped bore 42 with an outer portion 44 of larger diameter than an inner portion 46 and opening from fuel supply passage 26. Each end 48 of crossover and discharge conduits 33 and 34 is slidably received in the inner portion 46 of a conduit socket 40, and the outer portion 44 of each conduit socket 40 contains an O-ring 50 which is engaged between the outer portion 44 of the conduit socket 40 and the associated crossover or discharge conduit 33 or 34. The crossover and discharge conduits 33 and 34 have beads 52 forming shoulders disposed in the outer portions 44 of conduit sockets 40 to prevent displacement of O-rings 50 out of conduit sockets 40.

Figure 4:
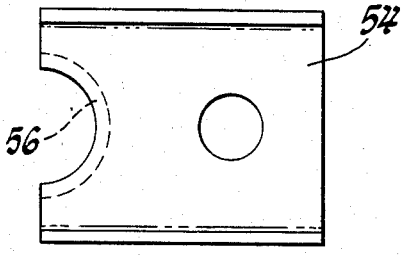
FIG. 4 is a plan view of a retainer employed to limit relative motion between the fuel rail and the conduit in the FIG. 1 assembly.

A pair of retainers 54 is secured by screws 55 to fuel rails 20 and 22 adjacent crossover conduit 33. As shown in FIGS. 2 and 4, each retainer 54 has a lip 56 embracing crossover conduit 33 and projecting into the outer portion 44 of the conduit socket 40. Under normal circumstances lip 56 does not engage the bead 52 on crossover conduit 33, but in the event of relative motion between fuel rails 20 and 22, lip 56 engages bead 52 to prevent withdrawal of the shoulder formed by bead 52 from the outer portion 44 of conduit socket 40 and to prevent withdrawal of the end 48 of crossover conduit 33 from the inner portion 46 of conduit socket 40.

Figure 5:
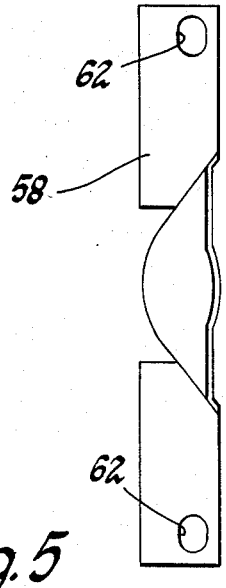
FIG. 5 is a plan view of a bracket employed to support a pressure regulator and to limit relative motion between the fuel rails in the FIG. 1 assembly.

The base 57 of pressure regulator 36 is secured to a bracket 58 which spans between and is secured by screws 60 (FIG. 3) to fuel rails 20 and 22. As illustrated in FIG. 5, the holes 62 in bracket 58 which receive screws 60 are enlarged to permit relative motion between fuel rails 20 and 22 but to preclude withdrawal of beads 52 on discharge conduit 34 from the outer portions 44 of conduit sockets 40 and further to preclude withdrawal of the ends 48 of discharge conduit 34 from the inner portions 46 of conduit sockets 40.

Figure 6:
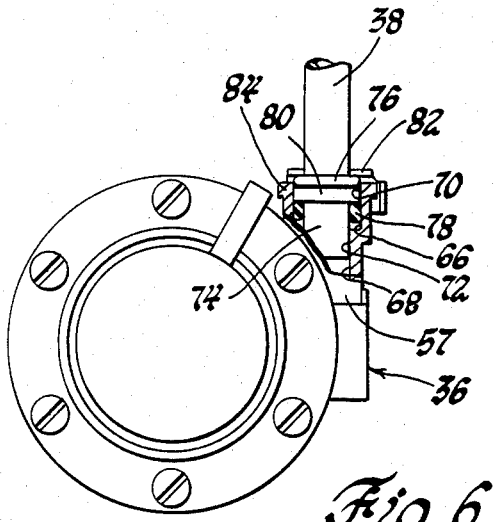
FIG. 6 is a view of the pressure regulator shown in FIG. 1, illustrating the intersection of the pressure regulator base with a fuel discharge line.

Fuel discharge line 38 is secured by clips 64 to fuel rail 22 and thus may experience motion relative to pressure regulator 36. As shown in FIG. 6, discharge line 38 is received in a socket 66 formed in the base 57 of pressure regulator 36. Socket 66 has a stepped bore 68 with an outer portion 70 of larger diameter than the inner portion 72. The end 74 of discharge line 38 is received in the inner portion 72 of socket 66, and a bead 76 on discharge line 38 forms a shoulder adjacent the outer portion 70 of socket 66. An O-ring 78 is engaged between discharge line 38 and the outer portion 70 of socket 66, and a spacer 80 surrounding discharge line 38 and extending into the outer portion 70 of socket 66 between the bead 76 and O-ring 78 forms a shoulder which prevents displacement of O-ring 78 out of socket 66. A clip 82 is disposed behind bead 76 and engages an external rim 84 about socket 66. Clip 82 permits relative motion between discharge line 38 and the base 57 of pressure regulator 36 but prevents withdrawal of the end 74 of discharge line 38 from the inner portion 72 of socket 66 and further prevents displacement of O-ring 78.

Figure 7:
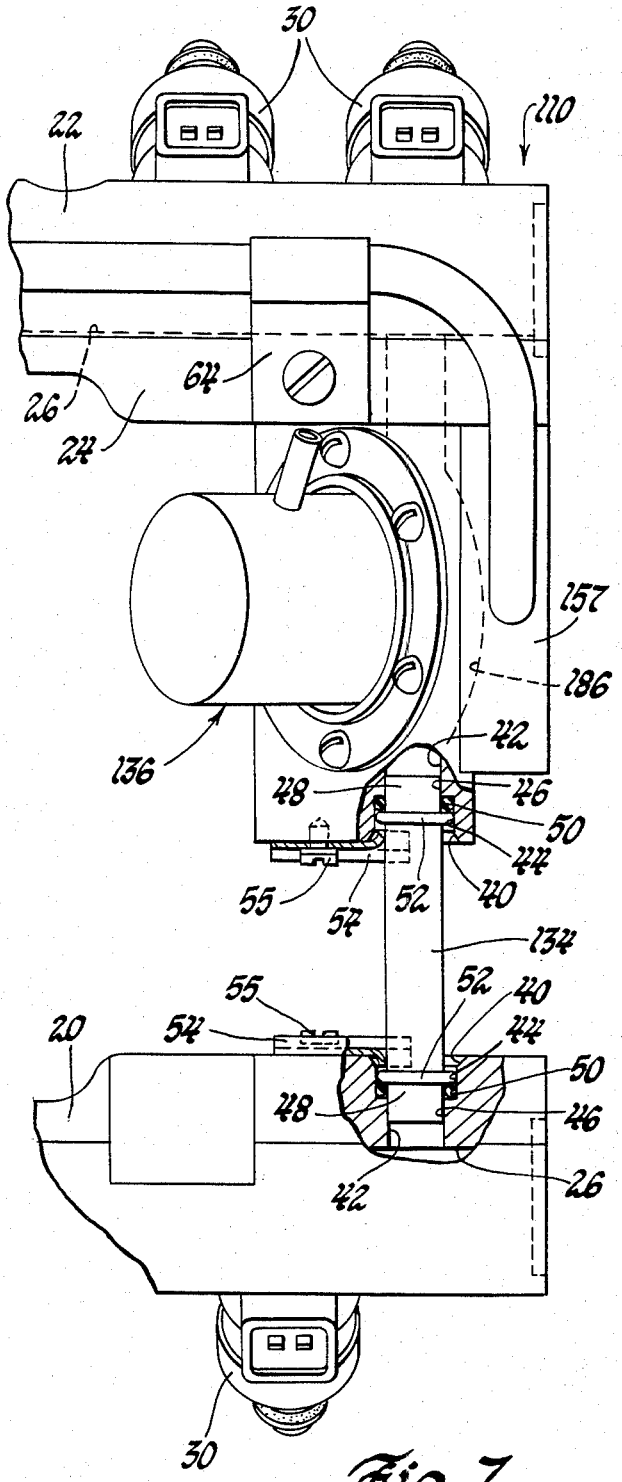
FIG. 7 is a plan view similar to FIG. 1 of another fuel rail assembly employing this invention.

FIG. 7 illustrates a fuel rail assembly 110 similar to fuel rail assembly 10 but in which the body or base 157 of the pressure regulator 136 is secured directly to and forms an extension of the body 24 of fuel rail 22. Pressure regulator base 157 has an access region 186 which opens from and forms an extension of the fuel supply passage 26 of fuel rail 22. Pressure regulator base 157 also has a conduit socket 40 formed by a stepped bore 42 with an outer portion 44 of larger diameter than an inner portion 46 and opening from chamber 186.

A discharge conduit 134 receives excess fuel from the fuel supply passage 26 of fuel rail 20 and directs the excess fuel to pressure regulator 136. The ends 48 of discharge conduit 134 are slidably received in the inner portions 46 of the conduit sockets 40 in fuel rail 20 and pressure regulator base 157. The outer portions 44 of those conduit sockets 40 contain O-rings 50 which are engaged between the outer portions 44 of those sockets and discharge conduit 134, and discharge conduit 134 has beads 52 forming shoulders disposed in the outer portions 44 of the sockets to prevent displacement of O-rings 50 out of the sockets.

A pair of retainers 54 is secured by screws 55 to fuel rail 20 and pressure regulator base 157 to limit relative motion between fuel rail 20 and pressure regulator base 157 and thereby to prevent withdrawal of the shoulders formed by beads 52 from the outer portions 44 of conduit sockets 40 and to further prevent withdrawal of the ends 48 of discharge conduit 134 from the inner portions 46 of conduit sockets 40.

From the foregoing, it will be appreciated that with this invention, a pair of fuel rails may be interconnected by a crossover conduit and/or a discharge conduit in a manner which allows limited relative motion of the fuel rails during installation on an engine, and in a manner which avoids loss of fuel from the rail-conduit intersection.

It also will be appreciated that engagement of the end 48 or 74 of a conduit with the inner portion 46 or 72 of a conduit socket—and engagement of the bead 52 or spacer 80 with the outer portion 44 or 70 of a conduit socket—provides a tube-in-socket connection which precludes side loading of the O-ring 50 or 78 and thereby prevents distortion of the O-ring which might otherwise cause it to disengage from the conduit or the outer portion of the conduit socket.

The embodiments of the invention in which an exclusive property or privilege is claimed are defined as follows:

1. A fuel rail assembly for a V-engine having a plurality of fuel injection regions arranged in two lines, said fuel rail assembly comprising a pair of fuel rails mountable adjacent said lines, each of said fuel rails having a plurality of axially spaced injector sockets and an axially extending fuel supply passage intersecting said sockets for supplying fuel to said sockets, each of said sockets being adapted to receive a fuel injector suitable for delivering fuel from its socket to one of said regions, each of said fuel rails also having a conduit socket open to its fuel supply passage, each of said conduit sockets having a stepped bore with an outer portion of larger diameter than an inner portion, a conduit having ends slidably received in said inner portions of said conduit sockets, O-rings engaged between said conduit and said outer portions of said conduit sockets, said conduit further having shoulders disposed in said outer portions of said conduit sockets for preventing displacement of said O-rings out of said outer portions of said conduit sockets, and means for permitting relative motion between said conduit and said fuel rails while limiting such motion to preclude withdrawal of said conduit ends from said inner portions of said conduit sockets and to further preclude withdrawal of said shoulders from said outer portions of said conduit sockets.

2. A fuel rail assembly for a V-engine having a plurality of fuel injection regions arranged in two lines, said fuel rail assembly comprising a pair of fuel rails mountable adjacent said lines, each of said fuel rails including an elongated body having a plurality of axially spaced injector sockets and an axially extending fuel supply passage intersecting said sockets for supplying fuel to said sockets, each of said sockets being adapted to receive a fuel injector suitable for delivering fuel from its socket to one of said regions, each of said fuel rail bodies also having a conduit socket intersected by its fuel supply passage, each of said conduit sockets having a stepped bore with an outer portion of larger diameter than an inner portion, a conduit having ends slidably received in said inner portions of said conduit sockets, O-rings engaged between said conduit and said outer portions of said conduit sockets, said conduit further having shoulders disposed in said outer portions of said conduit sockets for preventing displacement of said O-rings out of said outer portions of said conduit sockets, and means interconnecting said fuel rails for permitting relative motion between said conduit and said fuel rails while limiting such motion to preclude withdrawal of said conduit ends from said inner portions of said conduit sockets and to further preclude withdrawal of said shoulders from said outer portions of said conduit sockets, whereby said conduit interconnects the fuel supply passage in one of said bodies and the fuel supply passage in the other of said bodies, and whereby said fuel rails may experience relative motion without loss of fuel from said conduit sockets.

3. A fuel rail assembly for a V-engine having a plurality of fuel injection regions arranged in two lines, said fuel rail assembly comprising a pair of fuel rails mountable adjacent said lines, each of said fuel rails including an elongated body having a plurality of axially spaced injector sockets and an axially extending fuel supply passage intersecting said sockets for supplying fuel to said sockets, each of said sockets being adapted to receive a fuel injector suitable for delivering fuel from its socket to one of said regions, each of said fuel rail bodies also having a conduit socket intersected by its fuel supply passage, each of said conduit sockets having a stepped bore with an outer portion of larger diameter than an inner portion, a conduit having ends slidably received in said inner portions of said conduit sockets, O-rings engaged between said conduit and said outer portions of said conduit sockets, said conduit further having shoulders disposed in said outer portions of said conduit sockets for preventing displacement of said O-rings out of said outer portions of said conduit sockets, and means for permitting relative motion between said conduit and said fuel rails while limiting such motion to preclude withdrawal of said conduit ends from said inner portions of said conduit sockets and to further preclude withdrawal of said shoulders from said outer portions of said conduit sockets, whereby said conduit interconnects said fuel rails for fuel flow from the fuel supply passage in one of said bodies to the fuel supply passage in the other of said bodies, and whereby said fuel rails may experience relative motion without loss of fuel from said conduit sockets.

4. A fuel rail assembly for a V-engine having a plurality of fuel injection regions arranged in two lines, said fuel rail assembly comprising a pair of fuel rails mountable adjacent said lines, each of said fuel rails including an elongated body having a plurality of axially spaced injector sockets and an axially extending fuel supply passage intersecting said sockets for supplying fuel to said sockets, each of said sockets being adapted to receive a fuel injector suitable for delivering fuel from its socket to one of said regions, each of said fuel rail bodies also having a conduit socket intersected by its fuel supply passage, each of said conduit sockets having a stepped bore with an outer portion of larger diameter than an inner portion, a conduit having ends slidably received in said inner portions of said conduit sockets, O-rings engaged between said conduit and said outer portions of said conduit sockets, said conduit further having shoulders disposed in said outer portions of said conduit sockets for preventing displacement of said O-rings out of said outer portions of said conduit sockets, means interconnecting said fuel rail bodies for permitting relative motion between said conduit and said fuel rails while limiting such motion to preclude withdrawal of said conduit ends from said inner portions of said conduit sockets and to further preclude withdrawal of said shoulders from said outer portions of said conduit sockets, and a pressure regulator receiving fuel from said conduit, whereby said conduit interconnects said fuel rails for fuel flow from the fuel supply passages in said bodies to said pressure regulator, and whereby said fuel rails may experience relative motion without loss of fuel from said conduit sockets.

5. A fuel rail assembly for a V-engine having a plurality of fuel injection regions arranged in two lines, said fuel rail assembly comprising a pair of fuel rails mountable adjacent said lines, each of said fuel rails including an elongated body having a plurality of axially spaced injector sockets and an axially extending fuel supply passage intersecting said sockets for supplying fuel to said sockets, each of said sockets being adapted to receive a fuel injector suitable for delivering fuel from its socket to one of said regions, each of said fuel rail bodies having a first conduit socket intersected by one end of its fuel supply passage and a second conduit socket intersected by the other end of its fuel supply passage, each of said conduit sockets having a stepped bore with an outer portion of larger diameter than an inner portion, a crossover conduit having ends slidably received in said inner portions of said first conduit sockets, a discharge conduit having ends slidably received in said inner portions of said second conduit sockets, O-rings engaged between said conduits and said outer portions of each of said conduit sockets, each of said conduits further having shoulders received in said outer portions of the associated conduit sockets for preventing displacement of said O-rings out of said outer portions of said conduit sockets, means for permitting relative motion between said conduits and said fuel rails while limiting such motion to preclude withdrawal of said conduit ends from said inner portions of said conduit sockets and to further preclude withdrawal of said shoulders from said outer portions of said conduit sockets, and a pressure regulator receiving fuel from said discharge conduit, whereby said crossover conduit interconnects said fuel rails for fuel flow from the fuel supply passage in one of said bodies to the fuel supply passage in the other of said bodies, whereby said discharge conduit interconnects said fuel rails for fuel flow from the fuel supply passages in at least one of said bodies to said pressure regulator, and whereby said fuel rails may experience relative motion without loss of fuel from said conduit sockets.

6. A fuel rail assembly for a V-engine having a plurality of fuel injection regions arranged in two lines, said fuel rail assembly comprising a pair of fuel rails mountable adjacent said lines, each of said fuel rails including an elongated body having a plurality of axially spaced injector sockets and an axially extending fuel supply passage intersecting said sockets for supplying fuel to said sockets, each of said sockets being adapted to receive a fuel injector suitable for delivering fuel from its socket to one of said regions, each of said fuel rail bodies having a first conduit socket intersected by one end of its fuel supply passage, one of said fuel rails including a pressure regulator body having an access region open to the other end of its fuel supply passage, said pressure regulator body having a conduit socket open to said access region, the body of the other of said fuel rails having a second conduit socket intersected by the other end of its fuel supply passage, each of said conduit sockets having a stepped bore with an outer portion of larger diameter than an inner portion, a crossover conduit having ends slidably received in said inner portions of said first conduit socket, a discharge conduit having ends slidably received in said inner portions of said second conduit socket and said pressure regulator body conduit socket, O-rings engaged between each of said conduits and said outer portions of each of said conduit sockets, each of said conduits further having shoulders received in said outer portions of each of said conduit sockets for preventing displacement of said O-rings out of said outer portions of said conduit sockets, means for permitting relative motion between said conduits and said bodies while limiting such motion to preclude withdrawal of said conduit ends from said inner portions of said conduit sockets and to further preclude withdrawal of said shoulders from said outer portions of said conduit sockets, whereby said crossover conduit interconnects said fuel rail bodies for fuel flow from the fuel supply passage in one fuel rail body to the fuel supply passage in the remaining fuel rail body, whereby said discharge conduit interconnects said other fuel rail body and said pressure regulatory body for fuel flow from the fuel supply passage in said other fuel rail body to said access region in said pressure regulator body, and whereby said fuel rails may experience relative motion without loss of fuel from said conduit sockets.

7. A fuel rail assembly for an engine, said fuel rail assembly comprising a body having a fuel passage and a socket intersected by said fuel passage, said socket having a stepped bore with an outer portion of larger diameter than an inner portion, a tube having an end slidably received in said inner portion of said socket, an O-ring engaged between said tube and said outer portion of said socket, said tube further having a shoulder disposed in said outer portion of said socket for preventing displacement of said O-ring out of said outer portion of said socket, and means for permitting relative motion between said tube and said body while limiting such motion to preclude withdrawal of said tube end from said inner portion of said socket and to further preclude withdrawal of said shoulder from said outer portion of said socket, whereby said fuel body and said tube may experience relative motion without loss of fuel from said socket.

* * * * *